United States Patent [19]

Iwasaki

[11] Patent Number: 4,846,013

[45] Date of Patent: Jul. 11, 1989

[54] TORQUE TAKEOUT MECHANISM FOR ROTARY ELECTRONIC PART

[75] Inventor: Yukio Iwasaki, Furukawa, Japan

[73] Assignee: Alps Electric Co., Ltd., Japan

[21] Appl. No.: 214,783

[22] Filed: Jul. 1, 1988

Related U.S. Application Data

[63] Continuation of Ser. No. 908,410, Sep. 16, 1986, abandoned.

[30] Foreign Application Priority Data

Sep. 19, 1985 [JP] Japan ..... 60-141977

[51] Int. Cl.[4] ..... G05G 5/06

[52] U.S. Cl. ..... 74/531; 403/359; 74/527

[58] Field of Search ..... 74/531, 527, 501.5 R, 74/501.5 H, 502, 503, 500.5; 403/357, 359, 146, 148; 222/511, 516

[56] References Cited

U.S. PATENT DOCUMENTS

| | | | |
|---|---|---|---|
| 3,279,835 | 10/1966 | Krohm | 403/359 |
| 4,152,095 | 5/1979 | McKelvey | 74/531 |
| 4,185,539 | 1/1980 | Stratienko | 74/531 |
| 4,487,089 | 12/1984 | Harwood | 74/531 |
| 4,505,691 | 3/1985 | Kohler | 74/531 |
| 4,543,851 | 10/1985 | Gilbert | 74/531 |
| 4,545,322 | 10/1985 | Yang | 74/531 |
| 4,564,088 | 1/1986 | Takahashi et al. | 74/531 |
| 4,622,861 | 11/1986 | Hill | 74/531 |
| 4,651,970 | 3/1987 | Sadler | 74/531 |

FOREIGN PATENT DOCUMENTS

| | | | |
|---|---|---|---|
| 536307 | 1/1957 | Canada | 74/531 |
| 0117004 | 8/1984 | European Pat. Off. | 74/531 |
| 1497249 | 5/1969 | Fed. Rep. of Germany | 74/531 |

*Primary Examiner*—Richard E. Moore
*Assistant Examiner*—Vinh Luong
*Attorney, Agent, or Firm*—Guy W. Shoup; Paul J. Winters; Stephen L. Malaska

[57] ABSTRACT

A torque takeout mechanism for a rotary electronic part, such as a potentiometer, comprises a first rotor capable of rotating with the rotating shaft of the electronic part, a second rotor engaging with the first rotor, a flat plate disposed between the first and second rotors, a spring member resiliently sandwiched between the first rotor and the flat plate, and an O-ring made from rubber and resiliently sandwiched between the second rotor and the flat plate. The flat plate is held to the body of the electronic part so as not to be rotatable with the rotating shaft, but the plate is movable lonitudinally of the rotating shaft.

4 Claims, 1 Drawing Sheet

TORQUE TAKEOUT MECHANISM FOR ROTARY ELECTRONIC PART

This application is a continuation of application Ser. No. 908,410 filed Sept. 16, 1986, now abandoned.

FIELD OF THE INVENTION

The present invention relates to a torque takeout mechanism for a rotary electronic part.

BACKGROUND OF THE INVENTION

Grease or the like has been heretofore applied between the shaft and its bearing of a rotary electronic part such as a potentiometer to allow a torque to be delivered from the part, but the torque obtained is 200 g·cm at best. There is a demand for much greater torque in cases where the design of the electronic device requires a large knob to be mounted or where the torque must be matched to the larger torque of its neighboring electronic part.

SUMMARY OF THE INVENTION

The present invention is intended to satisfy the foregoing need. Accordingly, it is an object of the present invention to provide a torque takeout mechanism which is used for a rotary electronic part and which can be assembled easily and is able to produce a very great torque.

The above object is achieved by a mechanism for an electronic part, comprising: a first rotor capable of rotating with the rotating shaft of the part; a second rotor engaging with the first rotor; a flat plate disposed between the first and second rotors and incapable of rotating with the rotating shaft, the plate being capable of moving longitudinally of the rotating shaft; a spring member resiliently sandwiched between the first rotor and the flat plate; and a rubber ring resiliently sandwiched between the second rotor and the flat plate. The mechanism can be assembled easily and produce a much larger torque than is conventional.

DETAILED DESCRIPTION OF THE INVENTION

Figures 1, 2, 3:
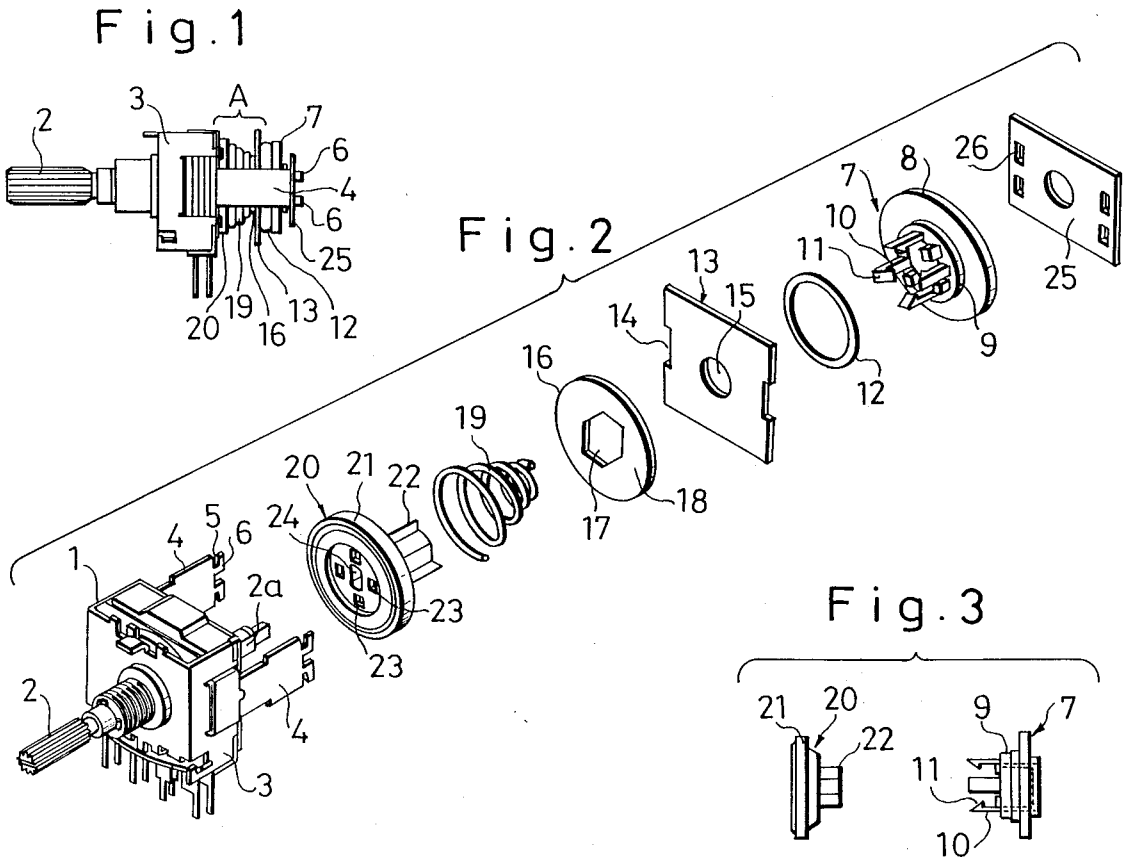
FIG. 1 is a side elevation of a mechanism according to the invention, and in which the mechanism has been assembled.
FIG. 2 is an exploded perspective view of the mechanism shown in FIG. 1.
FIG. 3 is a side elevation of the first and second rotors of the mechanism shown in FIGS. 1 and 2, for showing the manner in which they are brought into engagement with each other.

Referring to FIGS. 1 and 2, a rotary electronic part 1, such as a potentiometer, has a rotating shaft 2. Mounting legs 4 extend from both sides of the metal frame 3 of the part 1. Each front end of the legs 4 has notches 5 to form small bendable portions 6. A first molded rotor is generally indicated by reference numeral 20. A second molded rotor 7 has a disk portion 8, a jaw 9, and four mounting legs 10. These legs 10 are arranged into a circular form and extend on the opposite side of the jaw from the disk portion 8. The front ends of the legs 10 have claws 11 which can come into engagement with holes formed in the disk portion of the first rotor 20. A rubber ring 12 can be fitted over the jaw 9. A flat plate 13 has notches 14 on its both sides. The legs 4 of the part 1 can fit into the notches 14. The plate 13 is centrally provided with a hole 15 into which the jaw 9 can fit. A washer 16 is centrally provided with a hole 17 into which the legs 10 are loosely inserted. The fringe 18 of the washer can bear on the plate 13. A helical spring (spring member ) 19 can be loosely inserted into the space formed by the legs 10. The first rotor 20 has a disk portion 21 and a jaw 22. The disk portion 21 has holes 23 that the claws 11 at the front ends of the legs 10 extending from the second rotor 7 engage. The outside diameter of the disk portion 21 is larger than the outside diameter of the helical spring 19 to permit the spring 19 to engage the disk portion 21. The diameter of the jaw 22 is smaller than the outside diameter of the spring 19 in order that the spring 19 can be loosely mounted over the jaw 22. The jaw 2 has an oval hole 24 into which the oval portion **2*a* of the shaft 2 can fit. A rear side plate 25 is mounted between the legs 4**. The torque takeout mechanism is assembled and mounted to the electronic part in the manner described below.

First, the rubber ring 12 is fitted over the jaw 9 of the second rotor 7. Then, the jaw 9 is fitted into the hole 15 formed in the flat plate 13, so that the mounting legs 10 protrude from the plate 13. Subsequently, the washer 16 is loosely mounted around the legs 10. The helical spring 19 is then loosely mounted over the washer 16. Thereafter, the jaw 22 of the first rotor 20 is loosely inserted into the spring 19 to cause the disk portion 21 to compress the spring 19. Finally, the claws 11 at the front ends of the legs 10 of the second rotor 7 are made to engage the holes 23 in the disk portion 21 of the first rotor 20, thus fabricating a block A of the torque takeout mechanism.

Then, the oval portion **2*a* of the rotating shaft 2 of the electronic part 1 is inserted into the oval hole 24 in the first rotor 20 of the block A, and the legs 4 of the frame 3 are fitted into the notches 14 in the flat plate 13. The small bendable portions 6 at the front ends of the legs 4 are introduced into the holes 26 in the rear side plate 25. Subsequently, the bendable portions 6 are twisted to fix the plate 25 to the front ends of the legs 4**, thus completing the assembly operation.

In the torque takeout mechanism assembled as described above, the rubber ring 12 is resiliently sandwiched between the flat plate 13 and the disk portion 8 of the second rotor 7. The spring 19 and the washer 16 are resiliently sandwiched between the plate 13 and the disk portion 21 of the first rotor 20.

When the shaft 2 of the electronic part 1 is rotated, the first rotor 20 and the second rotor 7 rotate with the shaft 2, but the plate 13 is not allowed to turn. Therefore, when the ring 12 is frictionally rotated by the disk portion 8 of the second rotor 7, a large torque is transmitted to the plate 13 from the ring 12 via friction. Also, the spring 19 is frictionally rotated by the disk portion 21 of the first rotor 20. The washer 16 rotates with the spring 19, exerting a slight frictional force on the plate 13. Experiment has shown that the novel mechanism produced a torque of 600 g·cm, which is much larger than the torque produced heretofore.

In accordance with the illustrated embodiment of the invention, the torque takeout mechanism A can be fabricated as a block. This block can be mounted to the electronic part 1 manufactured separately. Hence, the device can be assembled easily. The obtained torque primarily arises from the frictional force produced between the rubber ring 12 and the flat plate 13, and can be made much larger than conventional. Further, the torque can be adjusted by varying the resilience of the helical spring 19. It is also possible to mount two or more blocks A of the torque takeout mechanism on the shaft 2. In this case, a larger torque can be created. The washer 16 can be omitted by using a belleville spring, for example, instead of the helical spring 19 and bringing the flat portion of the spring into resilient and direct contact with the flat plate 13.

The novel mechanism comprises: the first rotor capable of rotating with the rotating shaft; the second rotor engaging with the first rotor and capable of rotating with the shaft; the flat plate disposed between the first and second rotors, incapable of rotating with the rotating shaft, and capable of moving longitudinally of the rotating shaft; the spring member resiliently sandwiched between the first rotor and the flat plate; and the rubber ring resiliently sandwiched between the second rotor and the flat plate. When the shaft of the electronic part is rotated, the main friction is produced between the ring and the flat plate. That is, the ring and the plate make a sliding contact with each other. As a result, a larger torque can be obtained than conventional. Since the novel torque takeout mechanism can be manufactured as a block, the electronic part and the torque takeout mechanism can be separately manufactured and both are combined in the final manufacturing step. In this way, the device can be fabricated very easily. In addition, any desired value of torque can be derived by changing the resilience of the spring member. It is also possible to mount two or more torque takeout mechanisms on the rotating shaft of the electronic part. In this case, a larger torque can be obtained.

What is claimed is:

1. In an assembly of a rotary part having a stationary frame and a shaft which is rotated and has one end thereof extending from one side of the frame, and a torque takeout mechanism for providing torque resistance to the rotated shaft, the improvement comprising:

mounting members extending fixedly from the one side of the frame around the rotated end of the shaft;

a first rotor mounted on the shaft end for rotation therewith;

a second rotor having means for engaging the first rotor for rotation therewith;

a flat plate which is mounted to the mounting members and held non-rotatable by the mounting members relative to the rotated end of the shaft, and which is disposed between the first and second rotors;

a spring member resiliently sandwiched in contact between the first rotor and the flat plate, and a rubber ring sandwiched in contact between the second rotor and the flat plate, for providing torque resistance to the rotated shaft when the first and second rotors are rotated therewith relative to the non-rotatable flat plate.

2. A rotary part according to claim 1, wherein said mounting members include a pair of opposing legs extending in parallel with said shaft from said one side of said housing, said flat plate is provided with notches on opposite sides thereof for fritting on said legs, said rotor has a central shaped hole for fitting on said shaft end which is shaped correspondingly, and said first rotor, spring member, flat plate, rubber ring, and second rotor are assembled together as a block and mounted to the rotary part by the shaped hole of the first rotor being fitted onto the shaft end and the notches of the flat plate being fitted onto the legs of the mounting members.

3. A torque takeout mechanism as set forth in claim 1, wherein said spring member is a helical spring.

4. A torque takeout mechanism as set forth in claim 1, further comprising a washer mounted between the helical spring and the flat plate.

* * * * *